US010408505B2

(12) United States Patent
Goto et al.

(10) Patent No.: US 10,408,505 B2
(45) Date of Patent: Sep. 10, 2019

(54) SHOWCASE

(71) Applicant: FUJI ELECTRIC CO., LTD., Kawasaki-shi, Kanagawa (JP)

(72) Inventors: Mikio Goto, Kuwana (JP); Noriyuki Take, Yokkaichi (JP); Masanobu Ishibashi, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 2 days.

(21) Appl. No.: 14/930,094

(22) Filed: Nov. 2, 2015

(65) Prior Publication Data

US 2016/0135614 A1 May 19, 2016

(30) Foreign Application Priority Data

Nov. 18, 2014 (JP) ..... 2014-233674
Nov. 21, 2014 (JP) ..... 2014-237070
(Continued)

(51) Int. Cl.
*F25B 21/02* (2006.01)
*A47F 3/04* (2006.01)
*A47F 3/14* (2006.01)

(52) U.S. Cl.
CPC ..... *F25B 21/02* (2013.01); *A47F 3/04* (2013.01); *A47F 3/0404* (2013.01);
(Continued)

(58) Field of Classification Search
CPC .... A47F 3/0443; A47F 3/0408; A47F 3/0434; A47F 3/043; A47F 2003/046;
(Continued)

(56) References Cited

U.S. PATENT DOCUMENTS 2,252,237 A * 8/1941 Stiles ..... A47F 3/0404 312/122
2,529,384 A * 11/1950 Greiling ..... A47F 3/0443 62/251
(Continued)

FOREIGN PATENT DOCUMENTS

JP S55-144970 U 10/1980
JP S60-121182 U 8/1985
(Continued)

OTHER PUBLICATIONS

Japan Patent Office, "Office Action for Japanese Patent Application No. 2014-233674," dated Mar. 7, 2017.
(Continued)

*Primary Examiner* — Cassey D Bauer
*Assistant Examiner* — Miguel A Diaz
(74) *Attorney, Agent, or Firm* — Manabu Kanesaka

(57) ABSTRACT

A showcase includes: a box-shaped case main body sectioned into a storage room and a machine room by a heat insulating bottom plate; article mounting shelves arranged in a plurality of stages in an up-and-down direction in the storage room; a circulating fan configured to circulate air from inside the storage room between the storage room and the machine room; and a cooler arranged in the machine room and configured to cool the air circulated by the circulating fan. The heat insulating bottom plate includes a first air inlet formed in a face facing the storage room, a second air inlet formed at a position that is in a face facing the machine room and does not overlap with the first air inlet in the up-and-down direction, and an inlet flow channel formed so as to cause the first and the second air inlets to communicate with each other.

11 Claims, 19 Drawing Sheets

(30) Foreign Application Priority Data

Nov. 21, 2014 (JP) ..... 2014-237071
Nov. 21, 2014 (JP) ..... 2014-237072
Nov. 21, 2014 (JP) ..... 2014-237073

(52) U.S. Cl.
CPC ..... *A47F 3/0408* (2013.01); *A47F 3/0443* (2013.01); *A47F 3/0486* (2013.01); *A47F 3/145* (2013.01); *F25D 2317/063* (2013.01); *F25D 2317/065* (2013.01); *F25D 2317/0651* (2013.01)

(58) Field of Classification Search
CPC ..... A47F 3/0486; A47F 3/08; A47F 3/125; A47F 3/145; F25D 2317/063; F25D 23/068; F25D 23/069
See application file for complete search history.

(56) References Cited

U.S. PATENT DOCUMENTS 2,568,268 A * 9/1951 Booth ..... A47F 3/0408 62/251
3,304,736 A * 2/1967 Brennan ..... A47F 3/0447 454/193
3,324,676 A * 6/1967 Gerweck ..... A47F 3/0447 454/193
3,365,908 A * 1/1968 MacMaster ..... A47F 3/0447 62/256
3,369,375 A * 2/1968 Gerweck ..... A47F 3/0447 62/256
3,392,544 A * 7/1968 Perez ..... A47F 3/0447 62/256
3,420,070 A * 1/1969 Hermanson ..... A47F 3/0447 62/256
4,326,385 A * 4/1982 Ibrahim ..... A47F 3/0447 62/256
4,361,012 A * 11/1982 Ibrahim ..... A47F 3/0408 62/255
5,357,767 A * 10/1994 Roberts ..... A47F 3/0447 454/193
5,502,979 A * 4/1996 Renard ..... A47F 3/0443 312/116
5,517,826 A * 5/1996 Duffy ..... A47F 3/0443 312/116
5,606,863 A * 3/1997 Kicklighter ..... A47F 3/0413 62/248
5,675,983 A * 10/1997 Ibrahim ..... A47F 3/0443 62/255
5,709,096 A * 1/1998 Tamai ..... A47F 3/0447 62/155
5,743,098 A * 4/1998 Behr ..... A47F 3/0408 62/199
5,860,289 A * 1/1999 Wetzel ..... A47F 7/0078 62/255
5,974,818 A * 11/1999 Topper ..... A47F 3/0434 62/255
6,467,294 B1 * 10/2002 Walker ..... A47F 3/0447 62/255
6,519,962 B1 * 2/2003 Schuetter ..... A47F 3/0443 454/193
6,619,814 B1 * 9/2003 Hamada ..... A47F 3/001 362/125
6,672,092 B2 * 1/2004 Ruiz ..... A47F 3/001 62/246
6,886,359 B2 * 5/2005 Yamazaki ..... A47F 3/0443 454/193
6,948,324 B2 * 9/2005 Jin ..... F25D 19/02 62/298
7,357,000 B2 * 4/2008 Schwichtenberg ..... A47F 3/001 62/255
7,896,450 B2 3/2011 Yamazaki et al.
8,061,156 B2 * 11/2011 Hayase ..... A47F 3/0443 62/288
8,910,488 B2 * 12/2014 Fung ..... A47F 3/0443 62/256
9,144,327 B2 * 9/2015 Bryce ..... A47F 3/0408
9,675,185 B2 * 6/2017 Anderson ..... A47F 3/0447
2001/0003248 A1 * 6/2001 Otto ..... A47F 3/0408 62/255
2002/0005686 A1 * 1/2002 Nuttall ..... A47F 3/001 312/236
2002/0047506 A1 * 4/2002 George ..... A47F 3/0443 312/408
2002/0072323 A1 * 6/2002 Hakemann ..... A47F 3/001 454/233
2002/0162347 A1 * 11/2002 Walker ..... A47F 3/0447 62/256
2004/0069002 A1 * 4/2004 Chuang ..... A47F 3/0447 62/256
2005/0030736 A1 * 2/2005 Chuang ..... A47F 3/001 362/92
2005/0076662 A1 * 4/2005 Roche ..... A47F 3/0447 62/246
2005/0109040 A1 * 5/2005 Hansen ..... A47F 3/0434 62/3.6
2006/0049726 A1 * 3/2006 Hayase ..... A47B 57/20 312/128
2006/0107677 A1 * 5/2006 Iguchi ..... F25D 19/02 62/246
2006/0207276 A1 * 9/2006 Daddis, Jr. ..... A47F 3/0408 62/246
2006/0207278 A1 * 9/2006 Mead ..... A47F 3/0408 62/246
2006/0207279 A1 * 9/2006 Daddis, Jr. ..... A47F 3/0408 62/255
2007/0251253 A1 * 11/2007 Alahyari ..... A47F 3/0447 62/256
2008/0141690 A1 * 6/2008 Behr ..... A47F 3/0443 62/186
2008/0190128 A1 * 8/2008 Hayase ..... A47F 3/0443 62/288
2009/0044553 A1 * 2/2009 Tilley ..... A47F 3/0443 62/251
2009/0255287 A1 * 10/2009 Alahyari ..... A47F 3/0447 62/256
2010/0024446 A1 * 2/2010 Rohrer ..... A47F 3/0447 62/89
2010/0115969 A1 5/2010 Tuszkiewicz et al.
2011/0259031 A1 * 10/2011 Anderson ..... A47F 3/0447 62/251
2013/0019625 A1 * 1/2013 Bryce ..... A47F 3/0408 62/251
2013/0269382 A1 * 10/2013 Carter ..... A47F 3/0486 62/255
2016/0106232 A1 * 4/2016 Vonberg ..... A47F 3/0443 62/255
2016/0113419 A1 * 4/2016 Wood ..... A47F 3/0447 108/50.18
2016/0135614 A1 * 5/2016 Goto ..... A47F 3/0443 62/3.6
2016/0242572 A1 * 8/2016 Goto ..... A47F 3/06
2016/0278542 A1 * 9/2016 Eget ..... A47F 3/0408

FOREIGN PATENT DOCUMENTS

JP H02-20081 U 2/1990
JP H03-75478 A 3/1991
JP H11-108537 A 4/1999
JP H11-108538 A 4/1999
JP 2000-292051 A 10/2000
JP 2003-144276 A 5/2003
JP 2006-214630 A 8/2006
JP 2008-167927 A 7/2008
JP 2014-142081 A 8/2014

(56) References Cited

OTHER PUBLICATIONS

Japan Patent Office, "Office Action for Japanese Patent Publication No. 2014-237073," Sep. 25, 2018.
Japan Patent Office, "Office Action for Japanese Patent Publication No. 2014-237073," dated May 7, 2019.

* cited by examiner

SHOWCASE

CROSS-REFERENCE TO RELATED APPLICATION(S)

The present application claims priority to and incorporates by reference the entire contents of Japanese Patent Application No. 2014-233674 filed in Japan on Nov. 18, 2014, 2014-237070 filed in Japan on Nov. 21, 2014, 2014-237071 filed in Japan on Nov. 21, 2014, 2014-237072 filed in Japan on Nov. 21, 2014, 2014-237073 filed in Japan on Nov. 21, 2014.

BACKGROUND OF THE INVENTION

1. Field of the Invention

The present invention relates to a showcase.

2. Description of the Related Art

Japanese Patent Application Laid-open No. 2008-167927 discloses a showcase that is installed on a counter of a store such as a convenience store and accommodates articles so as to be visually recognizable from the outside.

Such a showcase includes a case main body. The case main body is formed in a box shape and has its interior sectioned into a storage room and a machine room. In the case main body, a front face constituting the storage room constitutes a customer serving face, and an opening is formed in a rear face constituting the storage room.

Article mounting shelves are arranged in a plurality of stages in the up-and-down direction in the storage room of the case main body. The article mounting shelves are configured to carry articles to be stored. The opening formed in the rear face of the case main body is opened and closed through right and left sliding movement of a plurality of glass doors.

In such a showcase, the front face (the customer serving face) or the like constituting the storage room in the case main body is formed of a transparent resin material or the like, thereby causing the articles carried on the article mounting shelves to be visually recognized through the customer serving face.

However, the showcase disclosed in Japanese Patent Application Laid-open No. 2008-167927 is a showcase exclusively for warming that has heaters arranged on the lower faces or the like of the respective article mounting shelves and heats the articles carried on the article mounting shelves. In this showcase, cooling of articles to be stored is not taken into consideration.

Given this situation, it is considered in the showcase disclosed in Japanese Patent Application Laid-open No. 2008-167927 that when the articles carried on the article mounting shelves are cooled, a cooler is arranged inside the case main body to cool the air inside the storage room by the cooler.

However, the storage room can be visually recognized from the outside, and the cooler is preferably arranged in the machine room in terms of good appearance and the like. When the cooler is thus arranged in the machine room, a heat insulating bottom plate that defines the storage room and the machine room needs to have an evacuating hole therein for evacuating the air inside the storage room into the machine room and a blowing hole for blowing out air cooled by the cooler from the machine room to the storage room.

The showcase is installed on a counter of a store as described above, and there are constraints on a height dimension, a width dimension, a depth dimension, and the like. Given this situation, the size of the machine room needs to be a required minimum in order to ensure the number of articles to be stored to a certain extent. In addition, the storage room has the article mounting shelves arranged in a plurality of stages to carry the articles, and when the evacuating hole is formed in accordance with the position of the cooler arranged in the machine room, an opening of the evacuating hole on the storage room side may overlap with the lowermost article mounting shelf and be blocked.

In other words, in the showcase, an area that can form an air inlet on a face facing the storage room and an area that can form the air inlet on a face facing the machine room may fail to overlap with each other in the up-and-down direction in the heat insulating bottom plate.

For that reason, an evacuating hole is inevitably formed in the heat insulating bottom plate in accordance with an arrangement state of the article mounting shelves in the storage room, and a flow channel or the like for feeding the air having passed through the evacuating hole to the cooler is inevitably arranged in the machine room. This situation brings about downsizing of the storage room caused by upsizing of the machine room and reduces the number of articles to be stored.

SUMMARY OF THE INVENTION

It is an object of the present invention to at least partially solve the problems in the conventional technology.

According to one aspect of the present invention, there is provided a showcase including: a box-shaped case main body having an interior thereof sectioned into a storage room and a machine room, the storage room being visually recognizable at least through a front face; article mounting shelves arranged in a plurality of stages in an up-and-down direction in the storage room and carrying thereon articles to be stored, the article carried on the article mounting shelves being visually recognizable through the front face; a circulating unit configured to circulate air from inside the storage room between the storage room and the machine room; a cooler arranged in the machine room and configured to cool the air circulated by the circulating unit; and a heat insulating bottom plate configured to allow the circulation of air by the circulating unit and define the storage room and the machine room, the heat insulating bottom plate including: a first air inlet formed in a face facing the storage room; a second air inlet formed at a position that is in a face facing the machine room and does not overlap with the first air inlet in the up-and-down direction; and an inlet flow channel formed so as to cause the first air inlet and the second air inlet to communicate with each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes a preferred embodiment of a showcase according to the present invention in detail with reference to the attached drawings.

Figure 1:
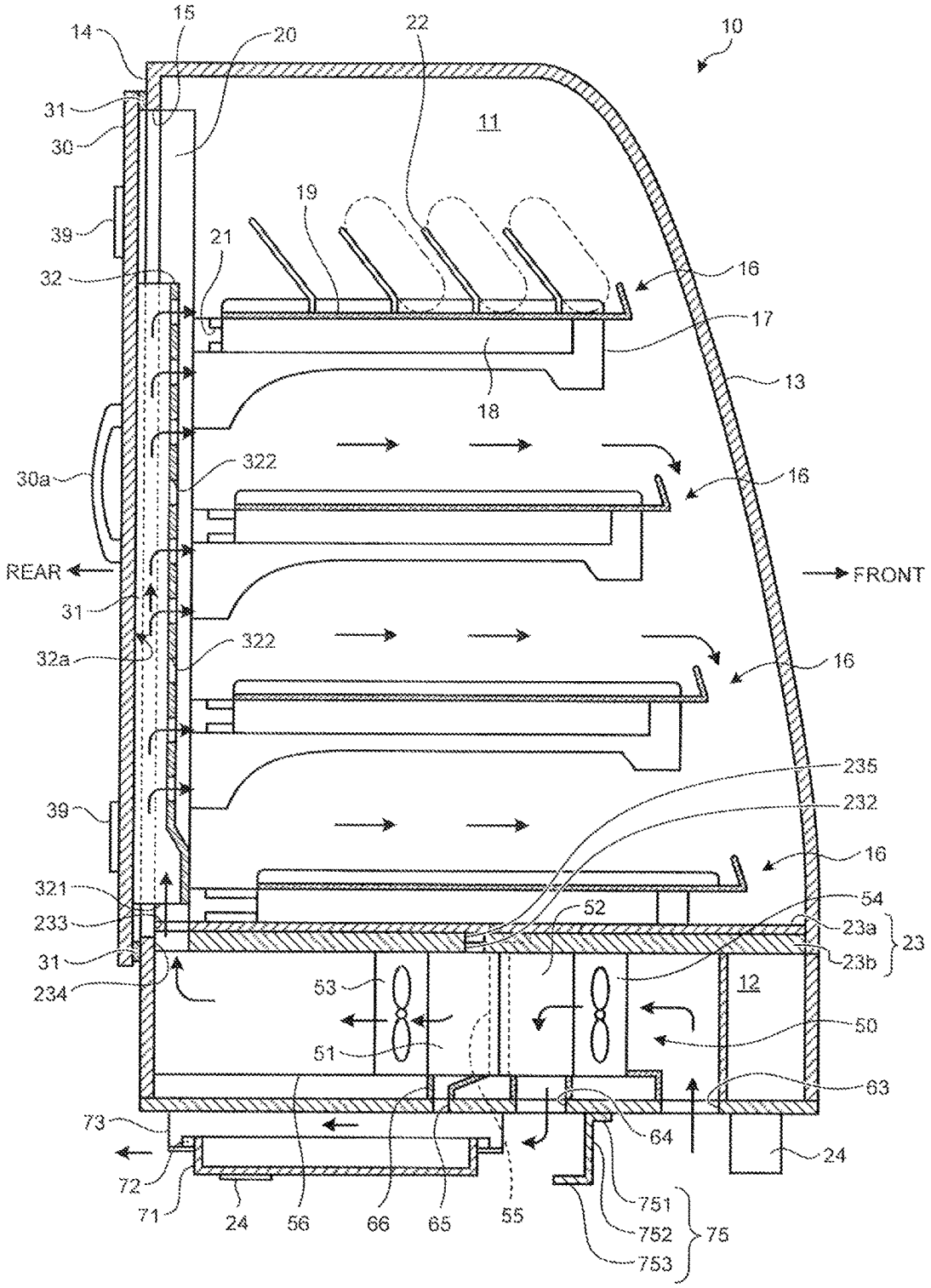
FIG. 1 is a sectional side view schematically illustrating an internal structure of a showcase as an embodiment of the present invention when viewed from the left side.

FIG. 1 is a sectional side view schematically illustrating an internal structure of a showcase as an embodiment of the present invention when viewed from the left side. The showcase exemplified in this example is installed on a counter of a store such as a convenience store to show articles such as donuts, for example, and includes a case main body 10, a door 30, and a cooling unit 50.

The case main body 10 is formed in a box shape and has its interior sectioned into a storage room 11 and a machine room 12 in the up-and-down direction. In the case main body 10, a front face 13 constituting the storage room 11 constitutes a customer serving face, and an opening (hereinafter, also referred to as a rear face opening) 15 is formed in a rear face 14 constituting the storage room 11. In the case main body 10, the front face 13 and right and left faces constituting the storage room 11 are both formed of a transparent glass material or resin material having a heat insulating structure, thereby enabling the storage room 11 to be visually recognized from the outside.

The storage room 11 of the case main body 10 has a plurality of article mounting shelves 16 arranged in a plurality of stages in the up-and-down direction.

Figure 2:
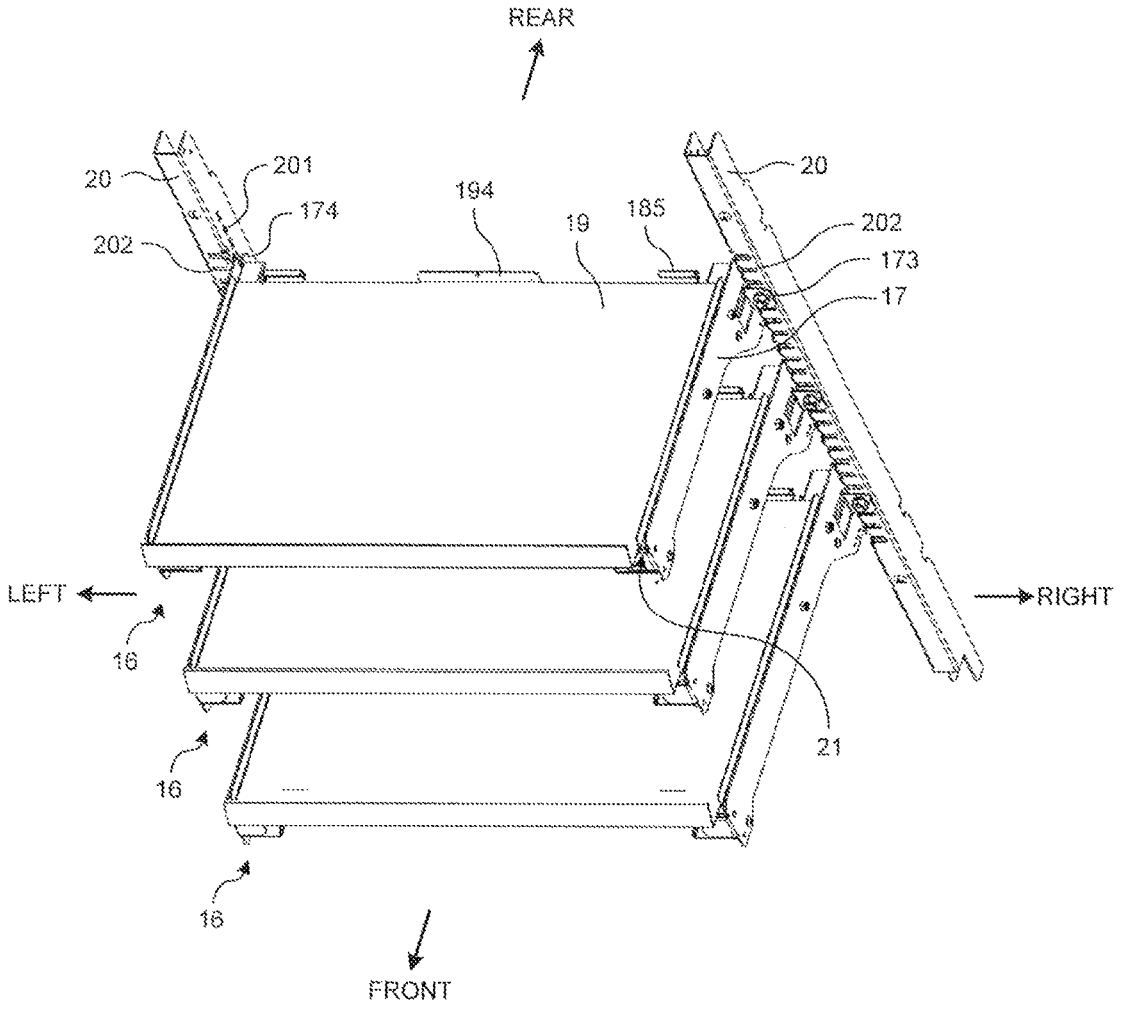
FIG. 2 is a perspective view illustrating a plurality of article mounting shelves in a storage room when viewed from the upper right side.
Figure 3:
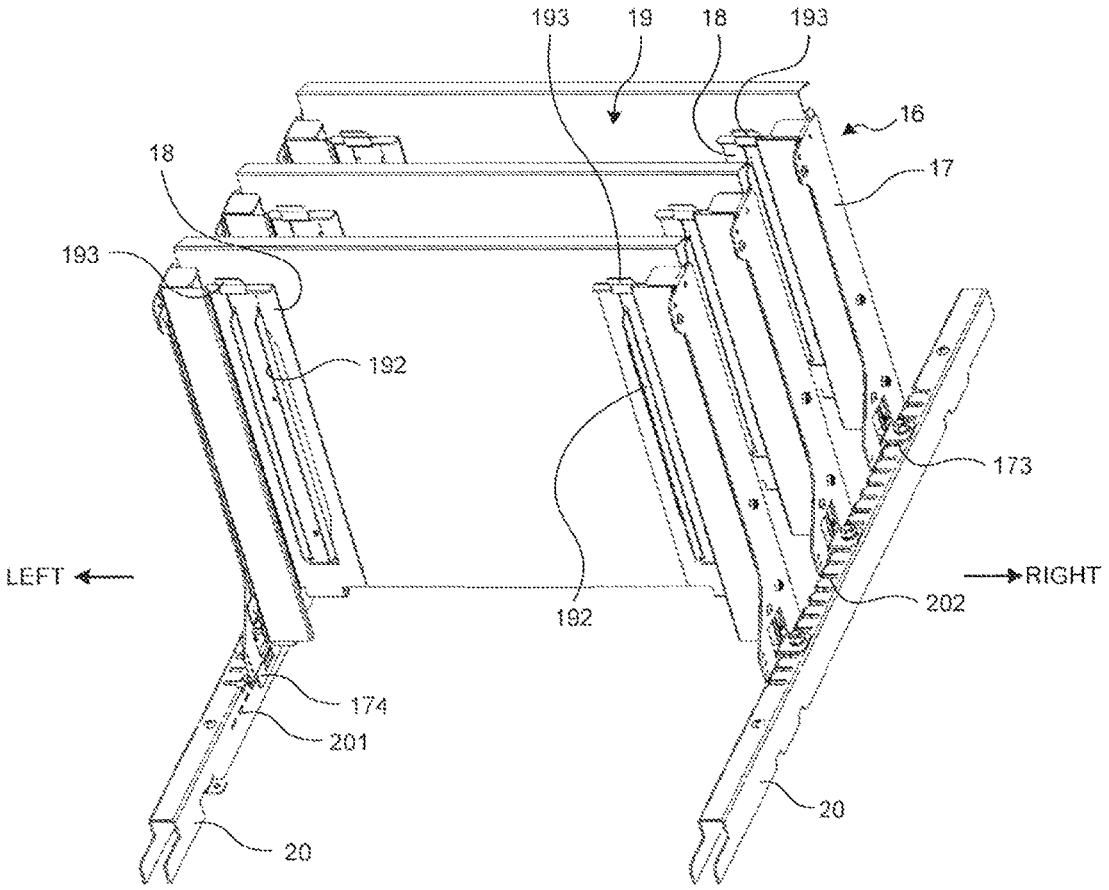
FIG. 3 is a perspective view illustrating the article mounting shelves in the storage room when viewed from the lower right side.

FIG. 2 and FIG. 3 illustrate the article mounting shelves 16 in the storage room 11. FIG. 2 is a perspective view when viewed from the upper right side, whereas FIG. 3 is a perspective view when viewed from the lower right side. As illustrated in FIG. 2 and FIG. 3, the article mounting shelf 16 includes brackets 17, receiving members 18, and a shelf board 19.

Figure 4:
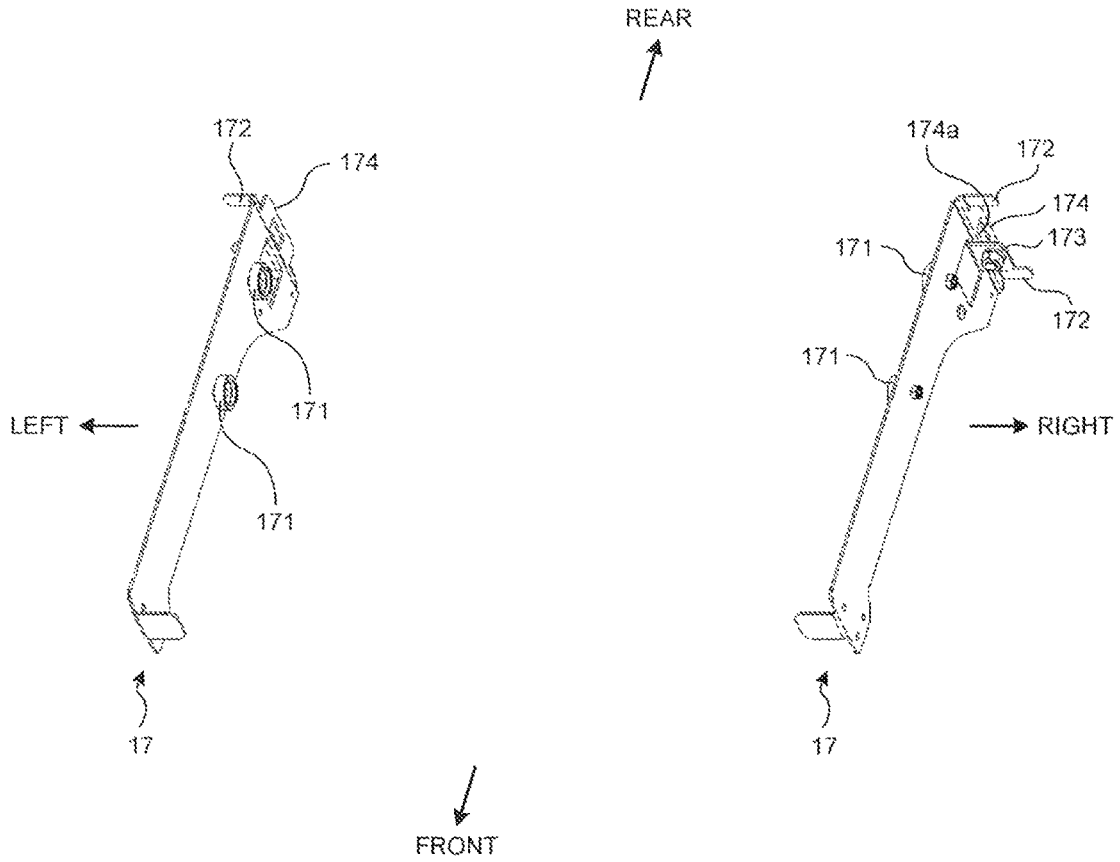
FIG. 4 is a perspective view illustrating brackets.

As illustrated in FIG. 4, the brackets 17 are a pair of right and left members. The brackets 17 are supported by shelf columns 20 so that inner faces thereof face each other. The "inner faces" in this example refer to the left face for the right bracket 17 and the right face for the left bracket 17. The left bracket 17 is different from the right bracket 17 only in the structure in the right-and-left direction, and the following describes the right bracket 17, with a description of the left bracket 17 omitted.

The shelf columns 20 are a pair of right and left members that are erected so that the inner faces thereof face each other at the rear side of the storage room 11. The shelf columns 20 are provided with first locking holes 201 and second locking holes 202. The "inner faces" in this example refer to the left face for the right shelf column 20 and the right face for the left shelf column 20.

The first locking holes 201 are rectangular holes formed at certain intervals in the up-and-down direction on the inner faces of the respective shelf columns 20. In other words, the first locking holes 201 formed at different height levels on the inner faces of the respective shelf columns 20 are formed so as to face each other in a right-and-left paired manner.

The second locking holes 202 are formed at certain intervals in the up-and-down direction on the front faces of the respective shelf columns 20. The second locking holes 202 are oblong holes formed in a continuous manner on the inner faces of the respective shelf columns 20. The up-and-down dimension of an opening part of the second locking hole 202 on the inner face of the shelf column 20 is formed larger than the up-and-down dimension of an opening part thereof on the front face of the shelf column 20.

The bracket 17 has two bracket rollers 171 arranged on the inner face thereof in a rotatable manner and is formed with locking pieces 172, a contact piece 173, and an engaging piece 174.

A plurality of (two in the illustrated example) locking pieces 172 are formed by separately bending a tongue-shaped part at the rear end of the bracket 17 in a direction opposite the other bracket 17, that is, rightward.

The contact piece 173 is formed by bending a rectangular part formed by cutting a part at the rear end of the bracket 17 and at the front side of the locking pieces 172 in the same direction as the locking pieces 172. In the central part of the contact piece 173, a locking pin 175 (refer to FIG. 6) that protrudes rearward is arranged. The locking pin 175 has its largest diameter that is smaller than the up-and-down dimension of a part opening in the inner face of the shelf column 20 in the second locking hole 202 and is larger than the up-and-down dimension of a part opening in the front face of the shelf column 20 in the second locking hole 202.

The engaging piece 174 is a plate-shaped part formed so as to protrude rearward at the rear end of the bracket 17 in between the two locking pieces 172. The engaging piece 174 is formed with a rectangular opening **174*a*** at the central part thereof.

Figure 5:
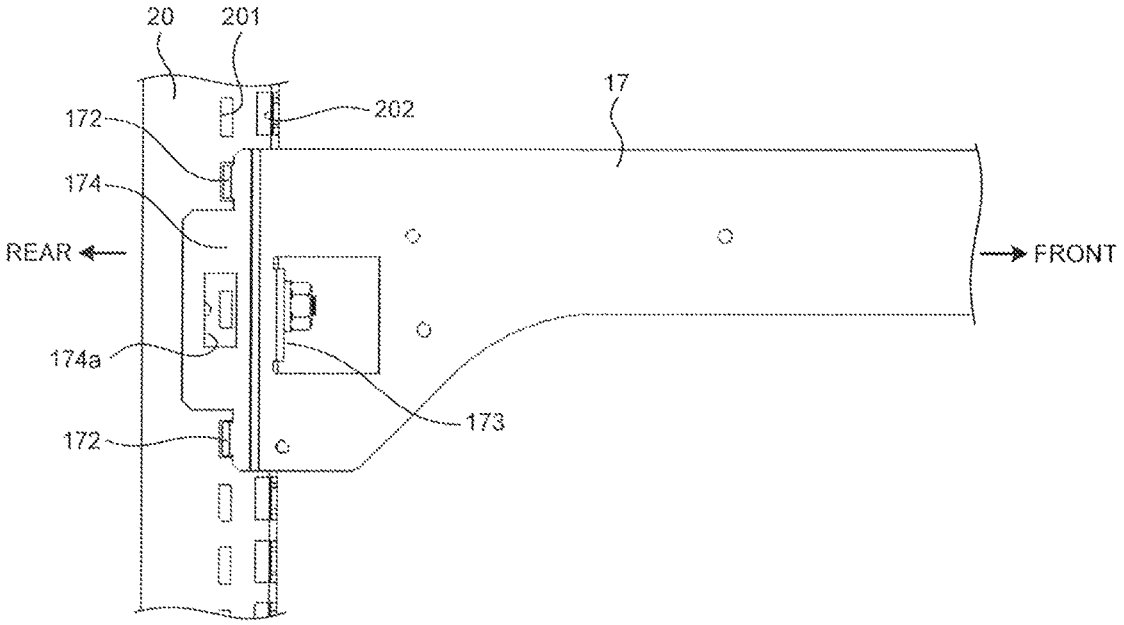
FIG. 5 is a left side view illustrating a state in which a right bracket is supported by a right shelf column.
Figure 6:
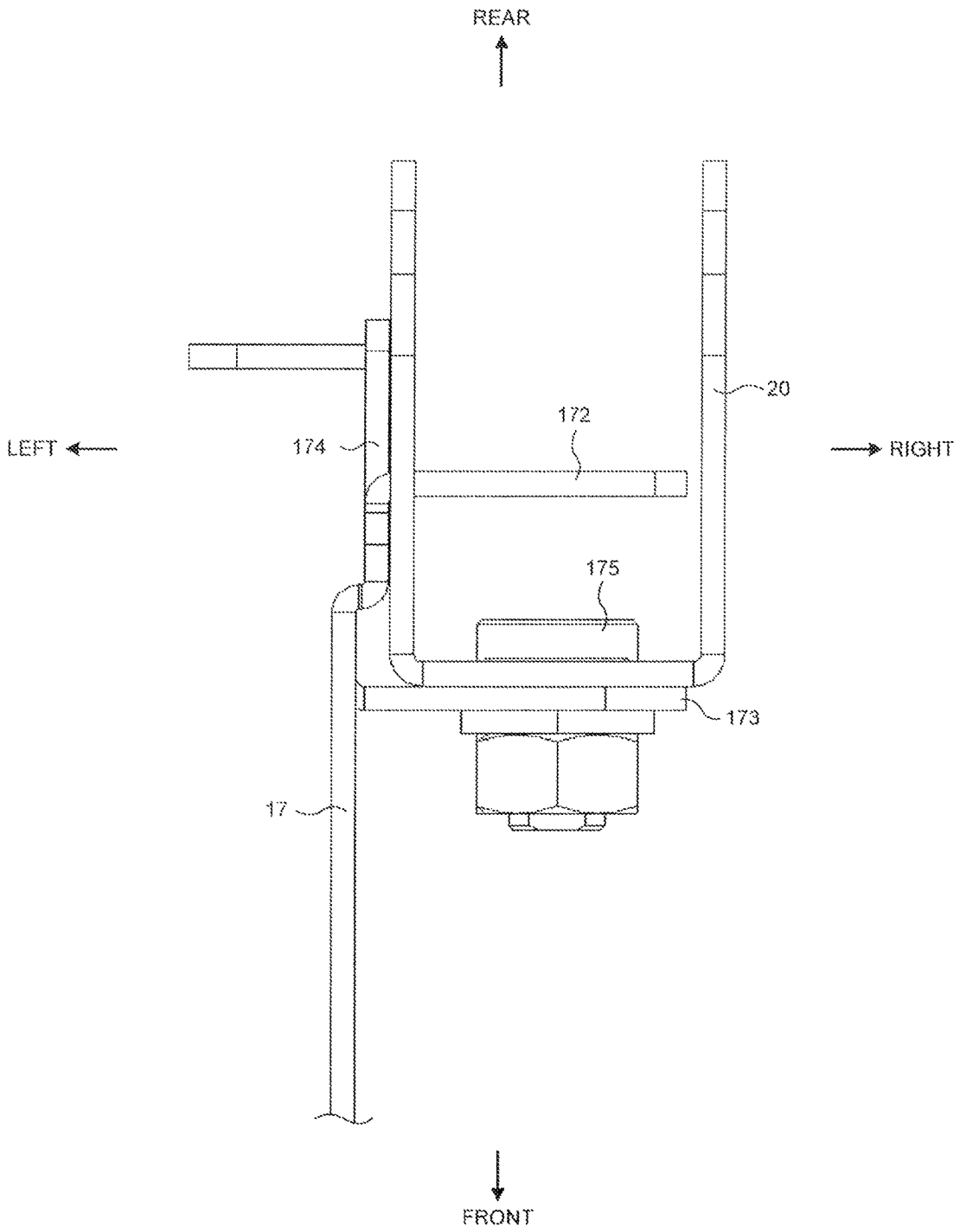
FIG. 6 is a plan view illustrating a state in which the right bracket is supported by the right shelf column.

FIG. 5 and FIG. 6 illustrate a state in which the right bracket 17 is supported by the right shelf column 20. FIG. 5 is a left side view, whereas FIG. 6 is a plan view.

The right bracket 17 is brought close to the right shelf column 20 from the left side, the locking pieces 172 are made to enter the first locking holes 201, and the locking pin 175 is made to enter the second locking hole 202, thereby bringing the contact piece 173 into contact with the front face of the shelf column 20 and bringing the engaging piece 174 into contact with the inner face of the shelf column 20, and thus the right bracket 17 is supported by the right shelf column 20. In this case, the largest diameter of the locking pin 175 is larger than the part opening in the front face of the shelf column 20 in the second locking hole 202, and the bracket 17 is prevented from being pulled out frontward. In addition, the contact piece 173 is in contact with the front face of the shelf column 20, and the bracket 17 is prevented from shaking in the up-and-down direction. Furthermore, the engaging piece 174 is in contact with the inner face of the shelf column 20, and the bracket 17 is prevented from shaking in the right-and-left direction.

Figure 7:
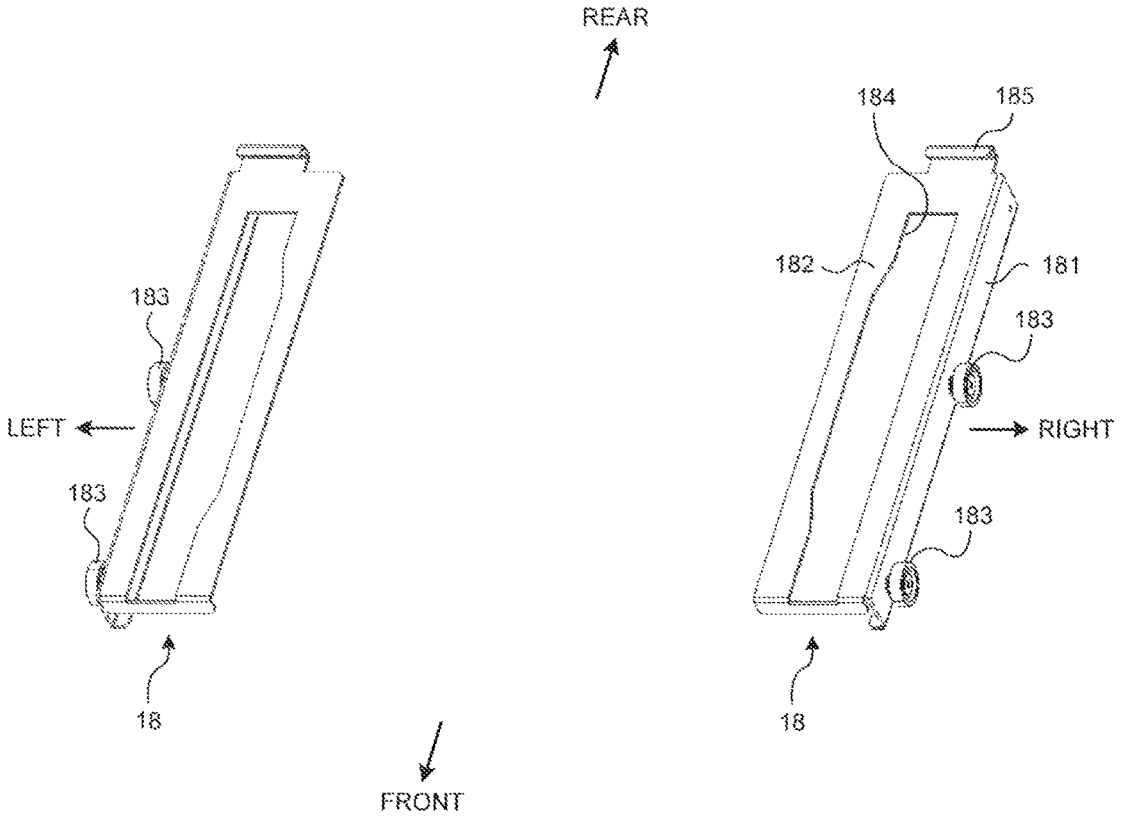
FIG. 7 is a perspective view illustrating receiving members.

As illustrated in FIG. 7, the receiving members 18 are a pair of right and left members. The left receiving member 18 is different from the right receiving member 18 only in the structure in the right-and-left direction, and the following describes the right receiving member 18, with a description of the left receiving member 18 omitted.

The receiving member 18 is a long member with the front-and-rear direction thereof being the longitudinal direction thereof and includes a base 181 extending in the front-and-rear direction and an upper face 182 extending leftward from the upper end edge of the base 181. The right face of the base 181 has two receiving unit rollers 183 arranged thereon in a rotatable manner. The upper face 182 is formed with an oblong hole 184 with the front-and-rear direction as the longitudinal direction thereof. The oblong hole 184 is formed so that the width of the central part in the longitudinal direction is larger than the widths of the front part and the rear part. The rear end of the upper face 182 is formed with a stopper 185. The stopper 185 is formed by bending a rectangular part protruding rearward at the rear end of the upper face 182 upward and then bending the rectangular part frontward.

Figure 8:
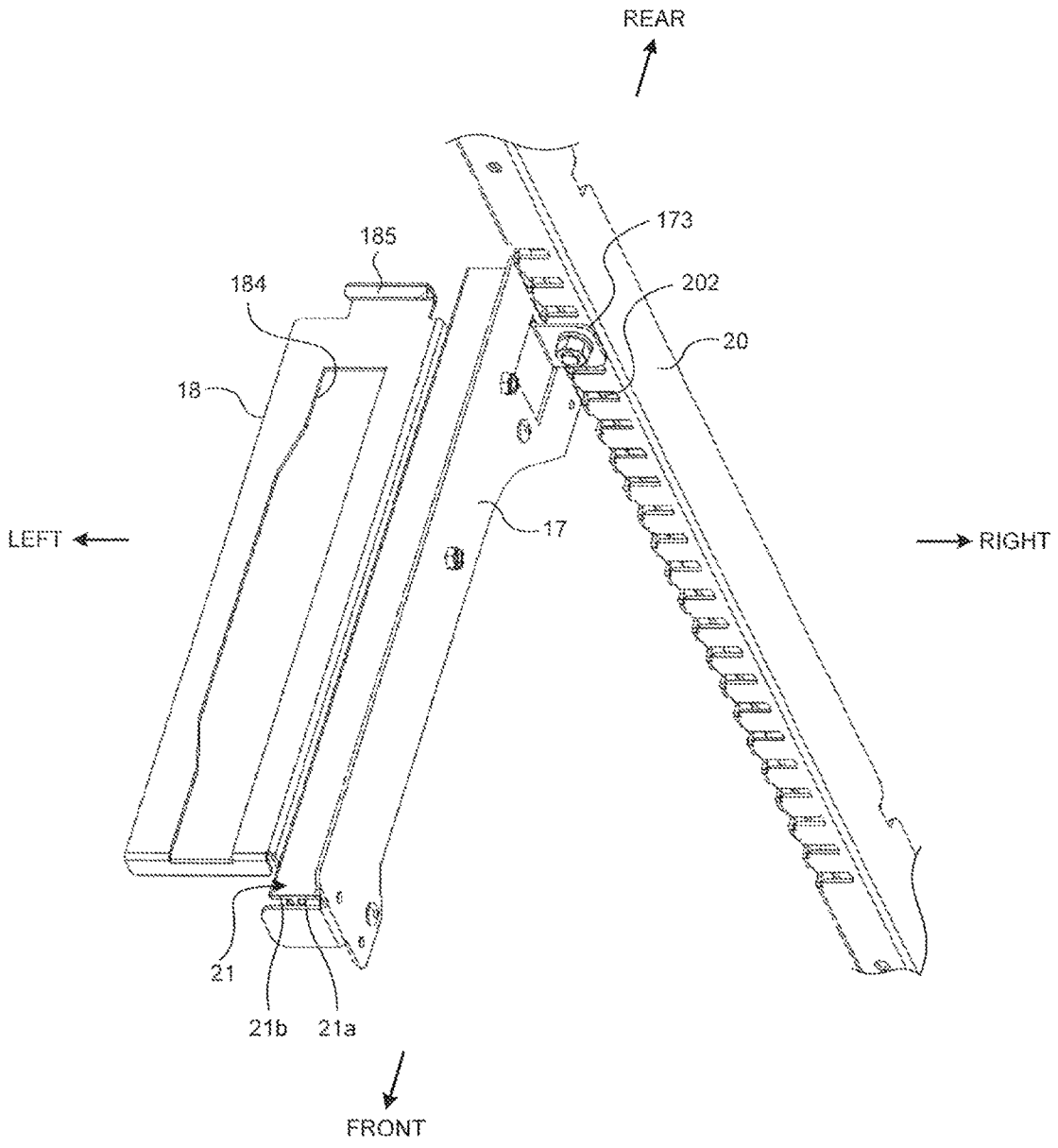
FIG. 8 is a perspective view illustrating the principal part of an article mounting shelf.

As illustrated in FIG. 8, the receiving member 18 is arranged on the inner face of the bracket 17 via a rail 21. The rail 21 is constituted by jointing a bracket rail 21*a* and a shelf rail 21*b* together.

Figure 9:
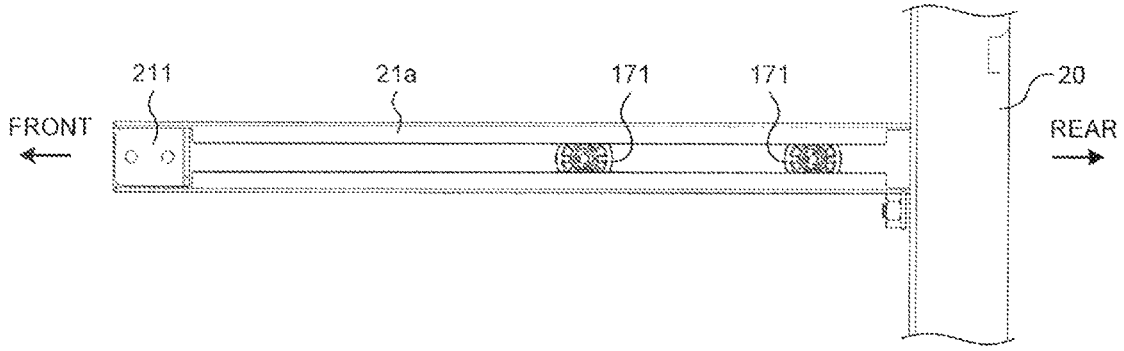
FIG. 9 is a right side view illustrating the principal part of a rail.

The bracket rail 21*a* is a long, rod-shaped member the longitudinal section of which is formed in a nearly U shape with the front-and-rear direction thereof being the longitudinal direction thereof. As illustrated in FIG. 9, the bracket rail 21*a* allows an entry of the bracket rollers 171 and rolls the bracket rollers 171. Reference sign 211 in FIG. 9 indicates a limiting member for preventing detachment of the rail 21.

Figure 10:
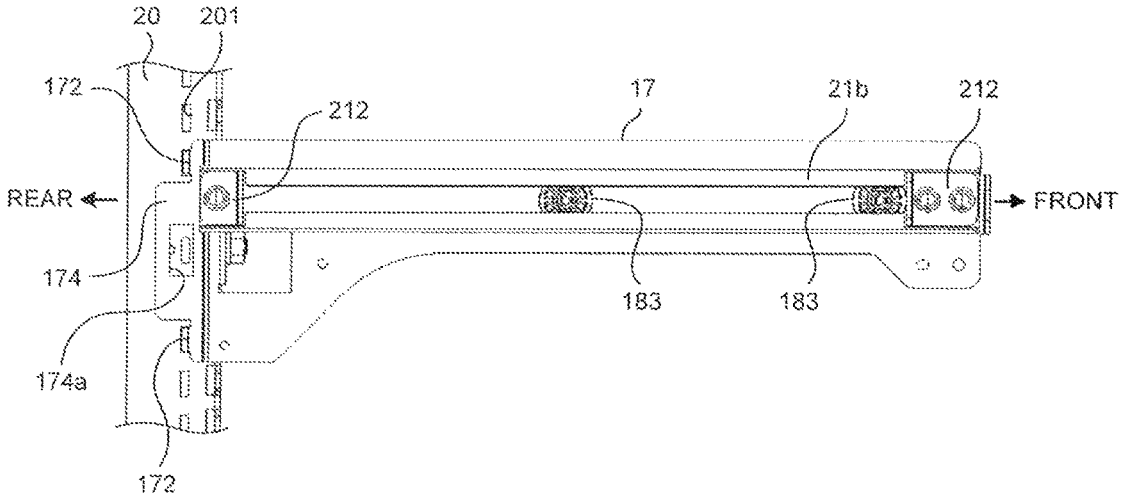
FIG. 10 is a left side view illustrating the principal part of the rail.

The shelf rail 21*b* is a long, rod-shaped member the longitudinal section of which is formed in a nearly U shape with the front-and-rear direction as the longitudinal direction thereof. As illustrated in FIG. 10, the shelf rail 21*b* allows an entry of the receiving unit rollers 183 and rolls the receiving unit rollers 183. Reference sign 212 in FIG. 10 indicates a limiting member for preventing detachment of the receiving member 18.

The bracket rollers 171 thus enter the bracket rail 21*a* and roll, thereby enabling the rail 21 to slidingly move in the front-and-rear direction with respect to the bracket 17. The receiving unit rollers 183 enter the shelf rail 21*b* of the rail 21 and roll, thereby enabling the receiving member 18 to slidingly move in the front-and-rear direction with respect to the rail 21. In other words, the receiving member 18 is arranged so as to be moveable in the front-and-rear direction with respect to the inner face of the bracket 17 via the rail 21.

The shelf board 19 is formed in a plate shape the upper face of which constitutes an article mounting face for mounting articles. Engaging members 191 are arranged at right and left opposite ends on the lower face of the shelf board 19. The engaging member 191 includes long protrusions 192 with the front-and-rear direction as the longitudinal direction thereof protruding downward. The lengths of the long protrusions 192 in the front-and-rear and right-and-left directions are sizes that enable an entry to the receiving oblong hole 184. The engaging member 191 has a hook 193 arranged at the front end of the long protrusions 192.

Figure 11:
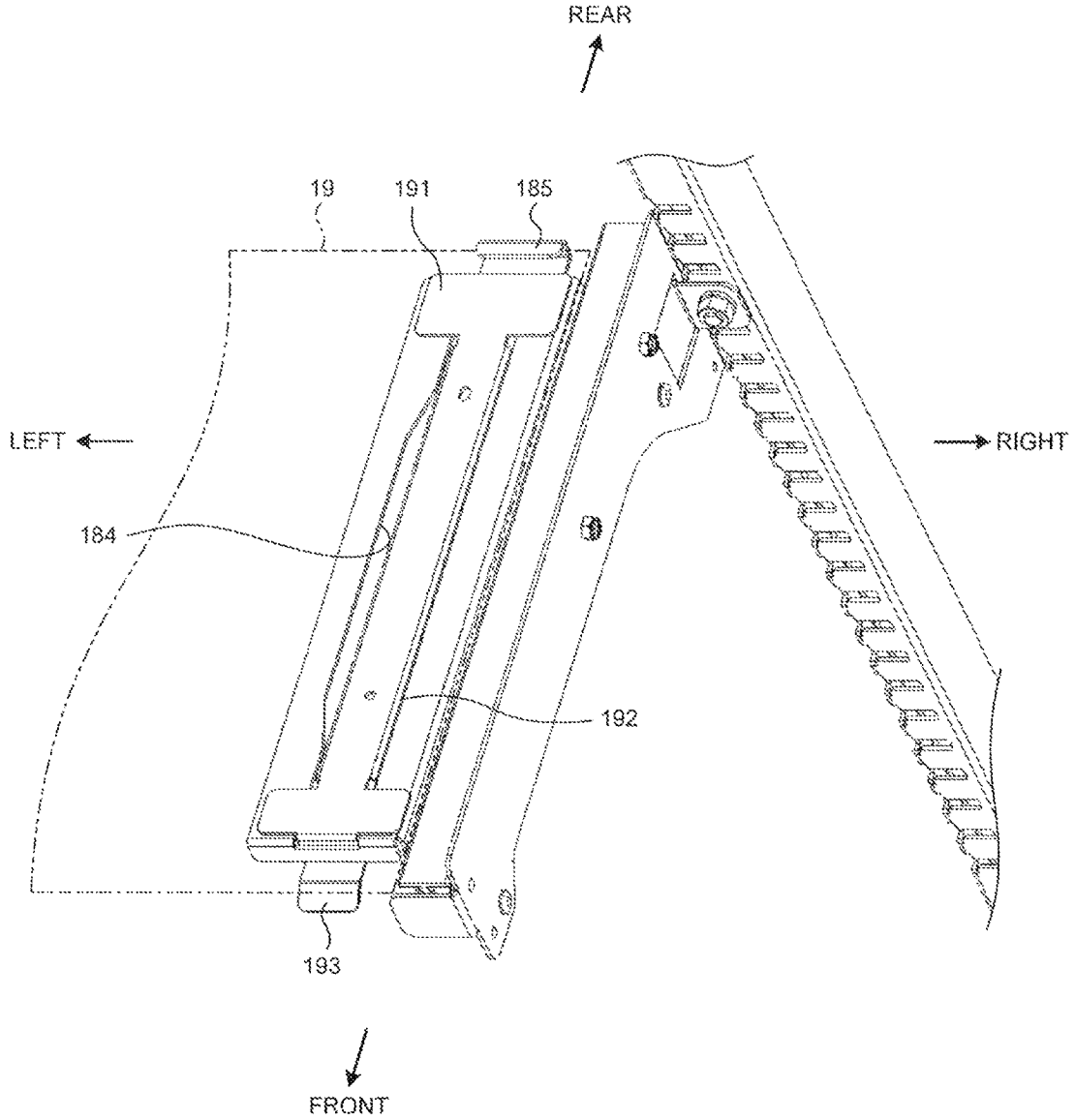
FIG. 11 is a perspective view illustrating the principal part of the article mounting shelf.

The shelf board 19 is engaged with the receiving members 18 so as to be astride the receiving members 18 by causing the long protrusions 192 of the respective engaging members 191 to enter the receiving oblong holes 184 of the respective receiving members 18, causing the hooks 193 to be engaged with the front edges of the receiving oblong holes 184 of the respective receiving members 18, and limiting backward movement by the reception stoppers 185 as illustrated in FIG. 2, FIG. 3, and FIG. 11.

The shelf board 19 is formed with a handle 194. The handle 194 is formed so as to extend upward at the central part in the right-and-left direction at the rear end of the shelf board 19.

The shelf board 19 can slidingly move in the front-and-rear direction with respect to the bracket 17 by being engaged with the receiving members 18. In other words, the shelf board 19 can slidingly move rearward through the rear face opening 15 when being operated to be pulled out and can slidingly move frontward through the rear face opening 15 when being operated to be pushed. The upper face of the shelf board 19 carries thereon articles such as donuts so as to be arranged in the front-and-rear direction and the right-and-left direction in the state of being supported by article guides 22.

The machine room 12 of the case main body 10 has the cooling unit 50 arranged therein. The cooling unit 50 includes a cooler 51, a radiator 52, a circulating fan (a circulating unit) 53, and a radiator fan 54.

The cooler 51 is arranged on the lower face of a heat insulating bottom plate 23 that defines the storage room 11 and the machine room 12, that is, on the lower side of a second air inlet 232 formed in a face facing the machine room 12.

Figure 12:
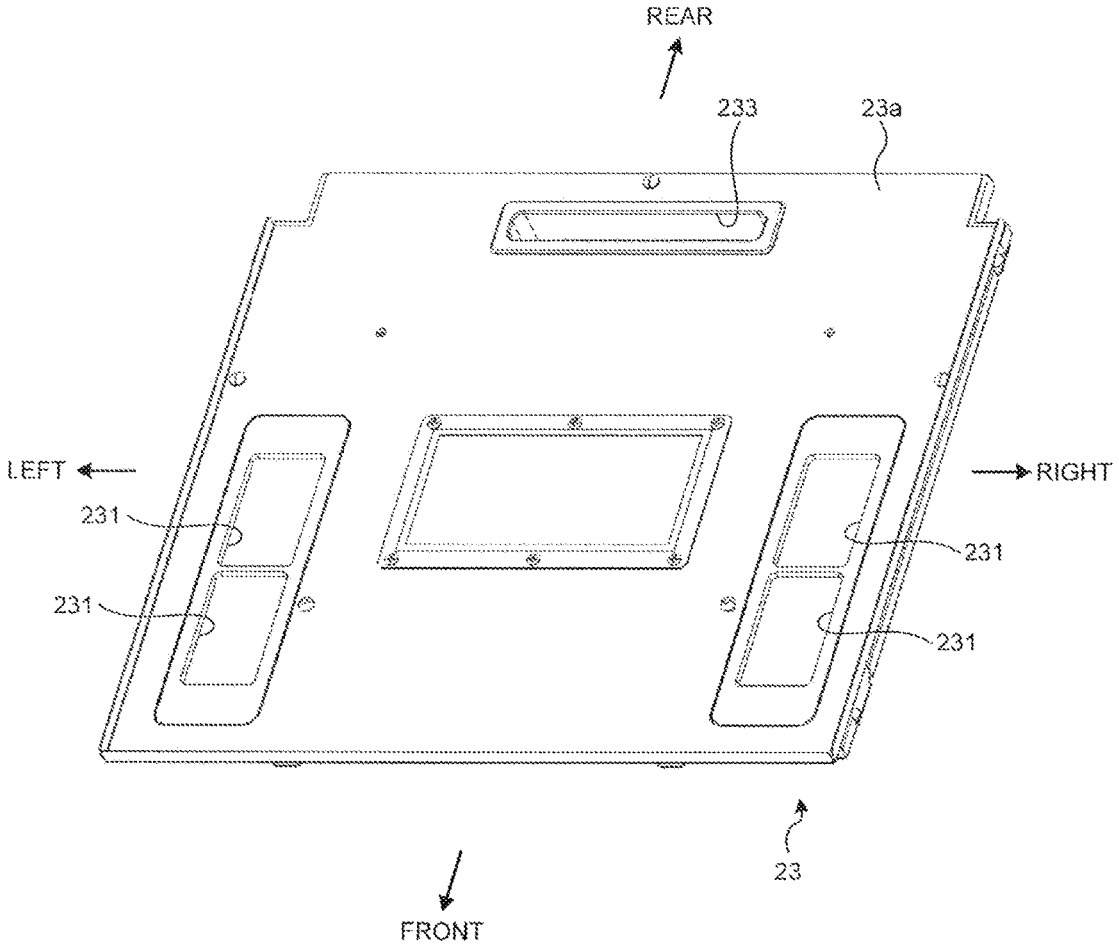
FIG. 12 is a perspective view illustrating a heat insulating bottom plate.
Figure 13:
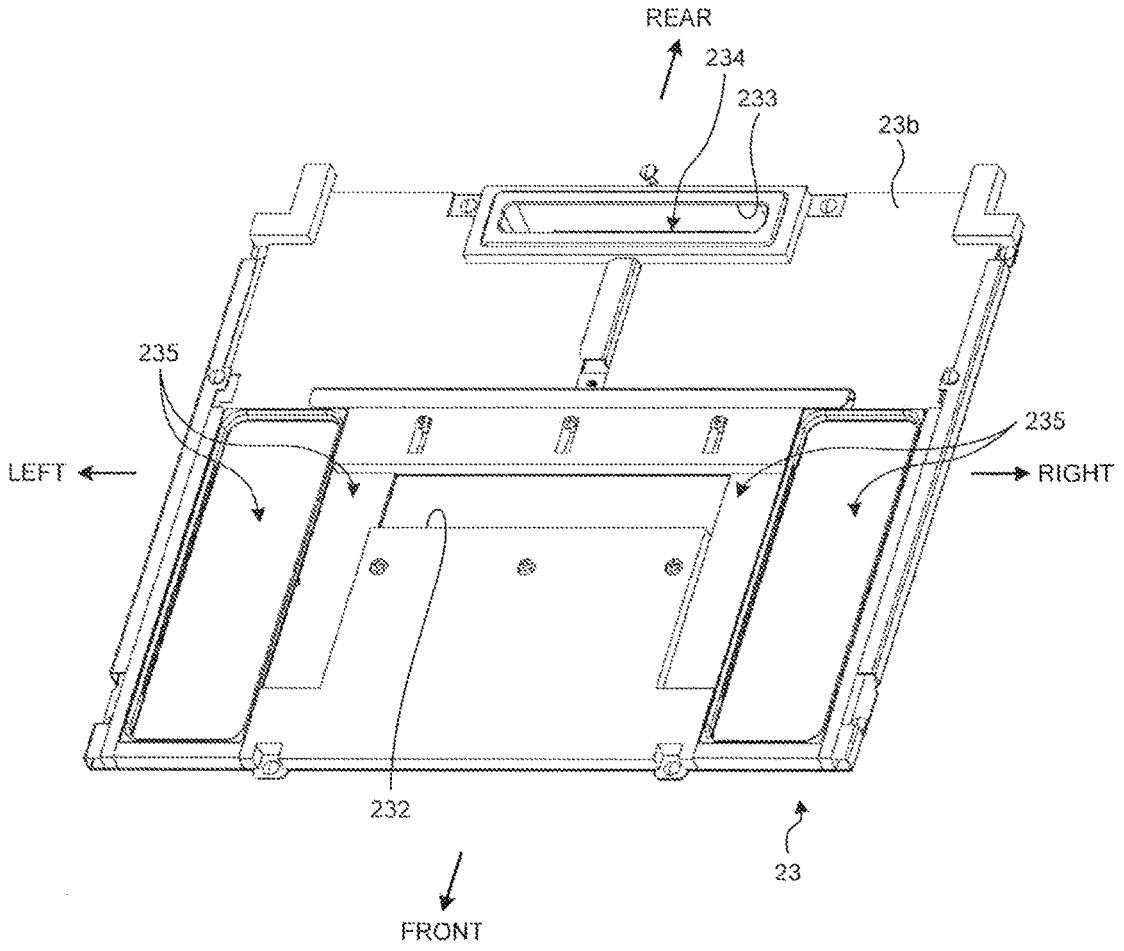
FIG. 13 is a perspective view illustrating a heat insulating board constituting the heat insulating bottom plate.

The following first describes the heat insulating bottom plate 23. As illustrated in FIG. 12 and FIG. 13, the heat insulating bottom plate 23 includes a deck pan 23*a* and a heat insulating board 23*b*.

The deck pan 23*a* is a plate-shaped member formed of, for example, a steel plate and is arranged so as to cover the upper face of the heat insulating board 23*b*. With this structure, the upper face of the deck pan 23*a* forms a face of the heat insulating bottom plate 23 facing the storage room 11. Right and left ends on the upper face of the deck pan 23*a* are both formed with rectangular first air inlets 231. The central area at the rear side of the deck pan 23*a* is formed with a first air outlet 233.

The heat insulating board 23*b* is a plate-shaped member formed of a heat insulating material. The lower face of the heat insulating board 23*b* forms the face of the heat insulating bottom plate 23 facing the machine room 12. The central part of the heat insulating board 23*b* is formed with the second air inlet 232 and is formed with inlet flow channels 235 that communicate with the second air inlet 232 by cutting. The inlet flow channels 235 cause the first air inlets 231 formed in the deck pan 23*a* and the second air inlet 232 to communicate with each other. A part at the rear side of the second air inlet 232 in the heat insulating board 23*b* and at the lower side of the first air outlet 233 is formed with a second air outlet 234. The second air outlet 234 communicates with the first air outlet 233.

As described above, in the heat insulating bottom plate 23, the first air inlets 231 and the second air inlet 232 are formed at the positions that do not overlap with each other in the up-and-down direction, and the first air inlets 231 and the second air inlet 232 communicate with each other via the inlet flow channels 235 formed in the heat insulating board 23*b*. The first air outlet 233 and the second air outlet 234 are formed at the positions that overlap with each other in the up-and-down direction and communicate with each other.

The cooler 51 is thermally connected to a low-temperature part of a Peltier element 55. The Peltier element 55 is a known element, in which p-type semiconductors and n-type semiconductors are alternately connected in series with electrode plates, and insulating plates are arranged on the front and back of the semiconductors. By giving a DC current to the electrode plates of the Peltier element 55, one insulating plate absorbs heat (to be a low-temperature part), whereas the other insulting plate generates heat (to be a high-temperature part).

The cooler 51 is formed of a material with excellent heat conductivity and includes a plurality of fins although not explicitly illustrated in the drawings, and spaces between the fins constitute an air passage for passing air. The cooler 51 cools the air passing through the air passage through coldness given from the Peltier element 55.

The radiator 52 is arranged at the front side of the cooler 51 and is thermally connected to the high-temperature part of the Peltier element 55. The radiator 52 is formed of a material with excellent heat conductivity and includes a plurality of fins, although not explicitly illustrated in the drawings, and spaces between the fins form an air passage for passing air. The radiator 52 heats the air passing through the air passage through high-temperature waste heat given from the Peltier element 55 to radiate heat.

The circulating fan 53 is arranged at the rear side of the cooler 51 within a wind tunnel 56 formed so that the second air inlet 232 and the second air outlet 234 communicate with each other. The circulating fan 53 is driven to draw air from within the storage room 11 through the first air inlets 231 and the second air inlet 232 and causes the drawn air to pass through the air passage of the cooler 51.

The circulating fan 53 blows out the air having passed through the air passage of the cooler 51 into the storage room 11 through the second air outlet 234 and the first air outlet 233, thereby circulating the air from within the storage room 11 between the storage room 11 and the machine room 12.

The radiator fan 54 is arranged at the front side of the radiator 52. The radiator fan 54 is driven to draw outside air through a drawing port 63 formed in a bottom face of the machine room 12 and cause the outside air to pass through the air passage of the radiator 52. The radiator fan 54 discharges the outside air having passed through the air passage of the radiator 52 to the outside through a discharge port 64 formed in the bottom face of the machine room 12.

The bottom face of the machine room 12, that is, the bottom face of the case main body 10 is provided with a drain water discharge port 65 in addition to the drawing port 63 and the discharge port 64, and a drain pan 71 and a guide member 75 are arranged thereon.

The drain water discharge port 65 is an opening that is formed at the rear side of the discharge port 64 and discharges drain water generated inside (the cooler 51, for example) the case main body 10 and having moved through a gutter 66 to the outside.

Figure 14:
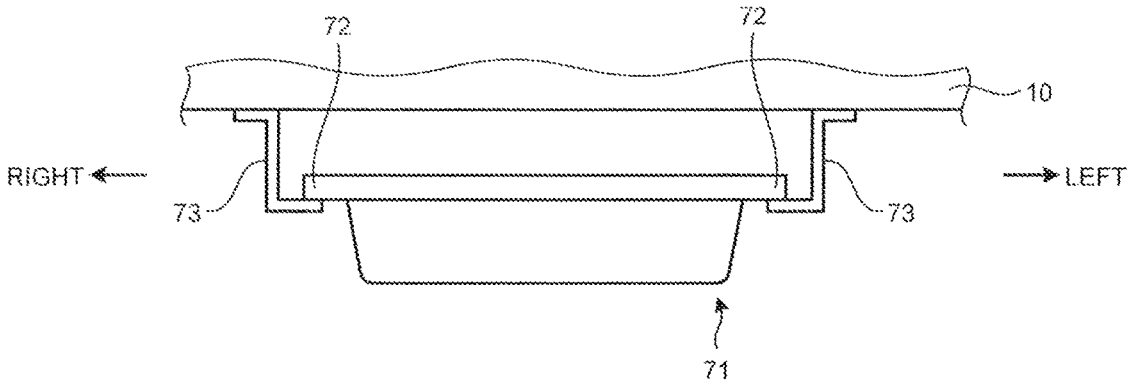
FIG. 14 is an illustrative diagram illustrating a drain pan illustrated in FIG. 1 when viewed from the rear side.

The drain pan 71 is arranged below the drain water discharge port 65 and stores therein the drain water discharged through the drain water discharge port 65. A flange 72 formed at the upper part of the drain pan 71 is supported by a pair of right and left drain supporting members 73 formed so as to protrude downward from the bottom face of the machine room 12, as illustrated in FIG. 14.

The guide member 75 is formed by bending a plate-shaped member and is arranged so as to protrude downward from the bottom face of the machine room 12 in between the drawing port 63 and the discharge port 64. The guide member 75 includes a guide base 751, a guide downward-extending part 752, and a guide rearward-extending part 753.

The guide base 751 is a part attached to the bottom face of the machine room 12. The guide downward-extending part 752 is a part that extends downward from the rear end edge of the guide base 751. The guide rearward-extending part 753 is a part that extends rearward from the lower end or the extension end of the guide downward-extending part 752.

The length of the guide member 75 in the right-and-left direction is formed larger than that of the drawing port 63 and the discharge port 64, so that the air blown out of the discharge port 64 is prevented from passing toward the drawing port 63 at the front side while guiding the air to pass near the drain pan 71 at the rear side. Reference sign 24 in FIG. 1 indicates a leg of the case main body 10.

The door 30 is for opening and closing the rear face opening 15 and is a plate-shaped member having a size enough to block the rear face opening 15. The door 30 is formed of transparent resin material or the like having heat insulating property.

A gasket 31 is arranged at the periphery of the front face of the door 30, that is, a part, when the rear face opening 15 is blocked, facing a metallic frame of the case main body 10 forming the periphery of the rear face opening 15. The gasket 31 is preferably a magnet gasket that can adhere to the periphery of the rear face opening 15 through magnetic force when the door 30 blocks the rear face opening 15.

Figure 15:
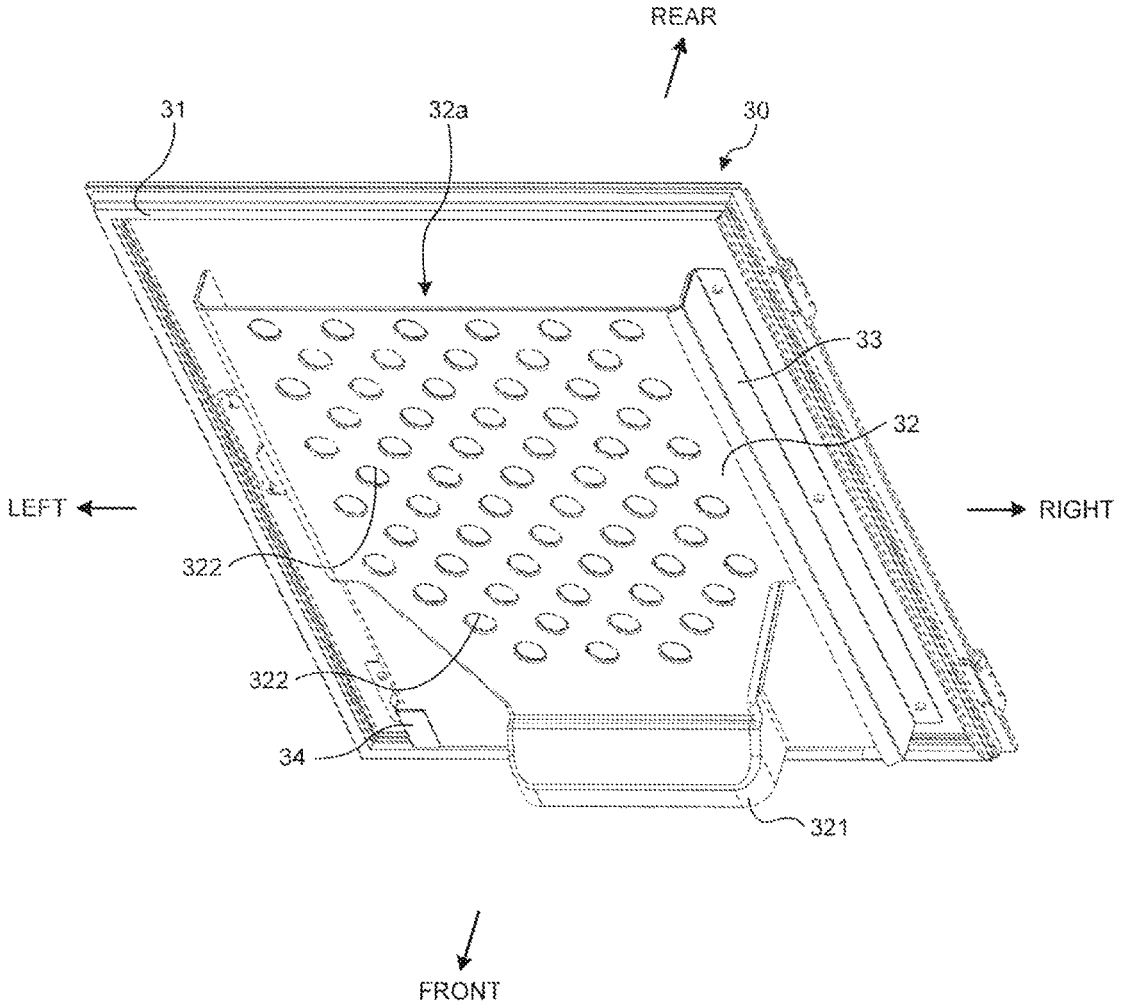
FIG. 15 is a perspective view illustrating a front face of a door when viewed from a right front upper area.
Figure 16:
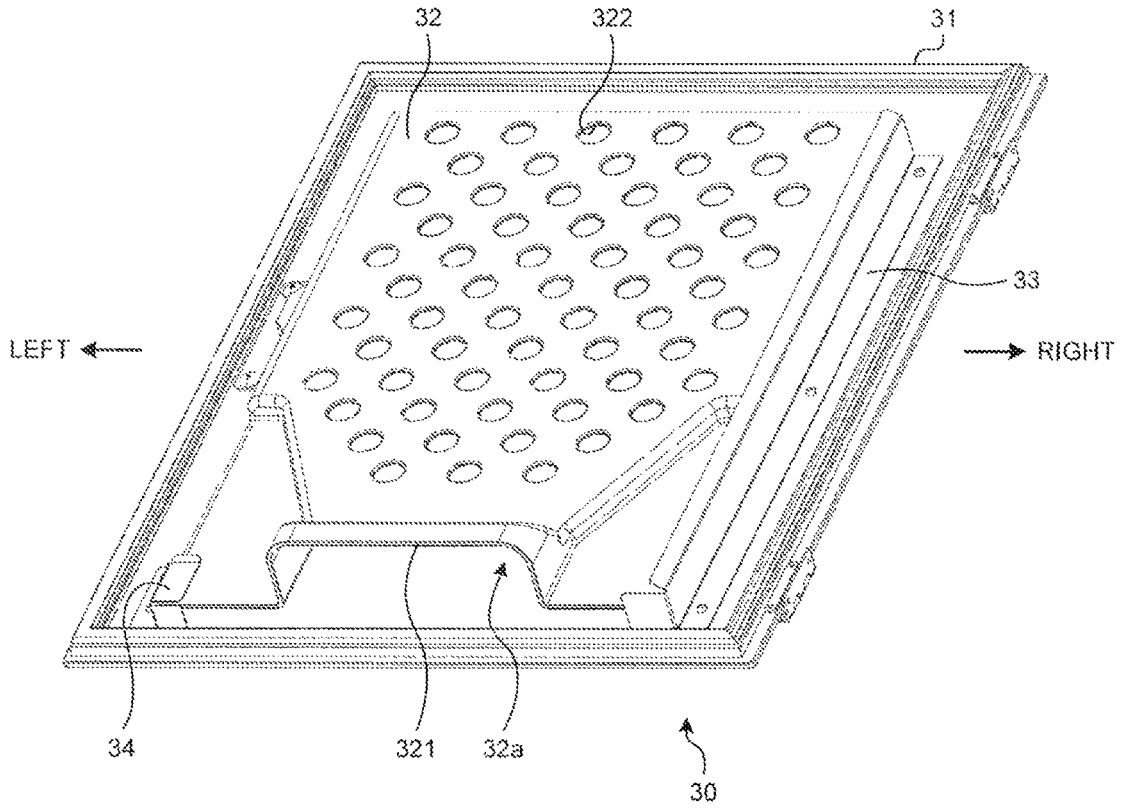
FIG. 16 is a perspective view illustrating the front face of the door when viewed from a right front lower area.
Figure 17:
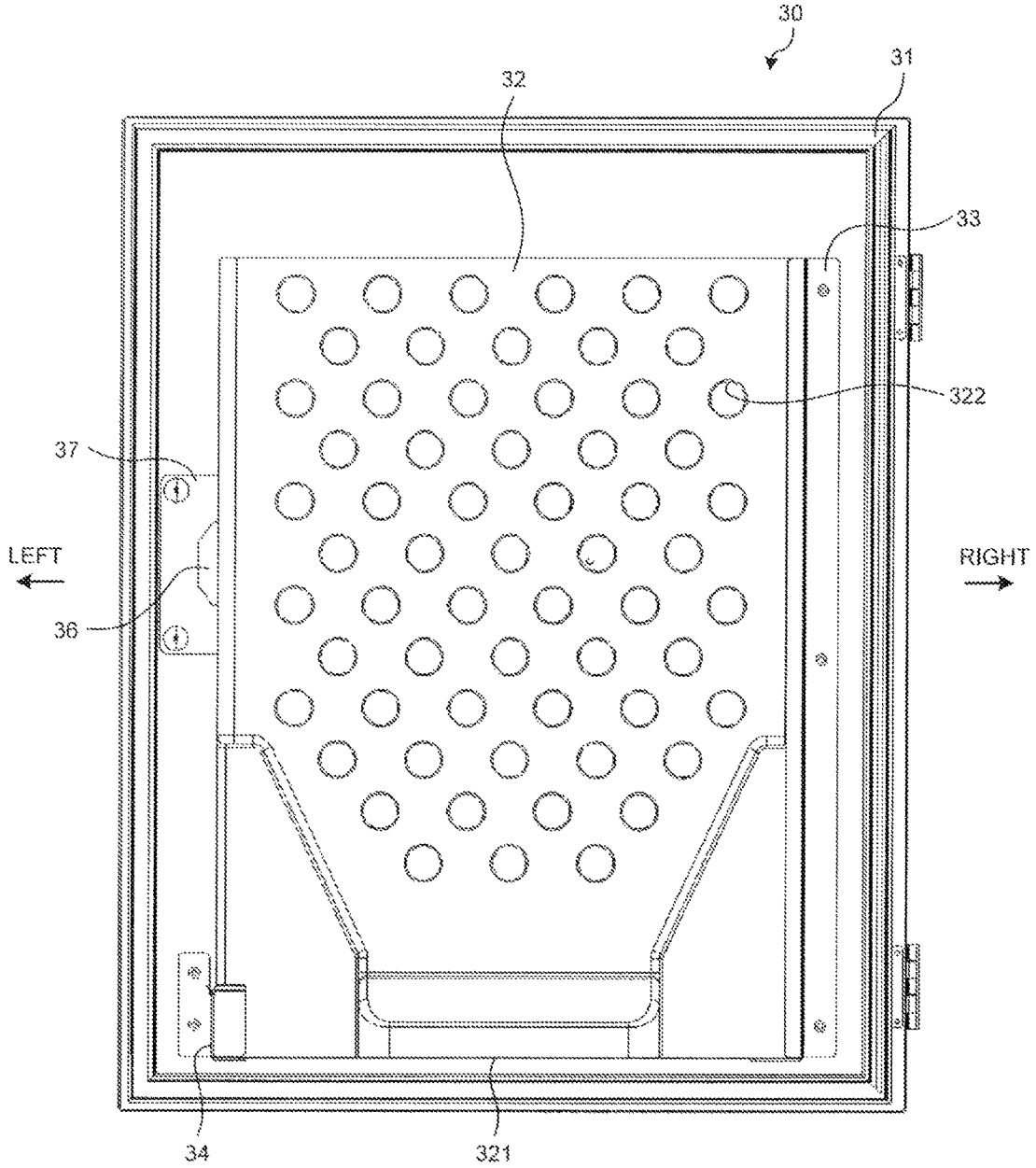
FIG. 17 is a front view of the front face of the door.

FIG. 15 to FIG. 17 illustrate a front face of the door 30. FIG. 15 is a perspective view when viewed from a right front upper area; FIG. 16 is a perspective view when viewed from a right front lower area; and FIG. 17 is a front view.

As illustrated in FIG. 15 to FIG. 17, the front face of the door 30 has a rear face duct 32 arranged thereon. The rear face duct 32 forms an air passage 32*a* extending in the up-and-down direction with the front face of the door 30 and includes an inlet 321 and injection holes 322.

The inlet 321 is an opening formed at a lower position and is an opening for introducing air when the circulating fan 53 is driven as described below. The air introduced through the inlet 321 passes through the air passage 32*a*. The inlet 321 is positioned above the first air outlet 233 when the door 30 blocks the rear face opening 15.

There are a number of injection holes 322 formed on the front face of the rear face duct 32, which are holes for injecting the air passing through the air passage 32*a* frontward when the circulating fan 53 is driven.

The rear face duct 32 is formed of a transparent resin material or the like together with the door 30. The rear face duct 32 has its right end held by a right duct cover 33 the right end of which is mounted on the front face of the door 30 so that rightward movement and downward movement are prevented, and has its left end held by a left duct cover 34 the lower side of the left end of which is mounted on the front face of the door 30 so that downward movement and leftward movement are prevented. Furthermore, the rear face duct 32 is arranged by causing a magnet 36 mounted on the left end to adhere to a magnetic plate 37 arranged on the front face of the door 30 through magnetic force. In other words, the rear face duct 32 can be detached from the door 30 by detaching the magnet 36 from the magnetic plate 37 and moving the magnet 36 upward, thereby arranging the rear face duct 32 on the front face of the door 30 in a detachable manner.

Figure 18:
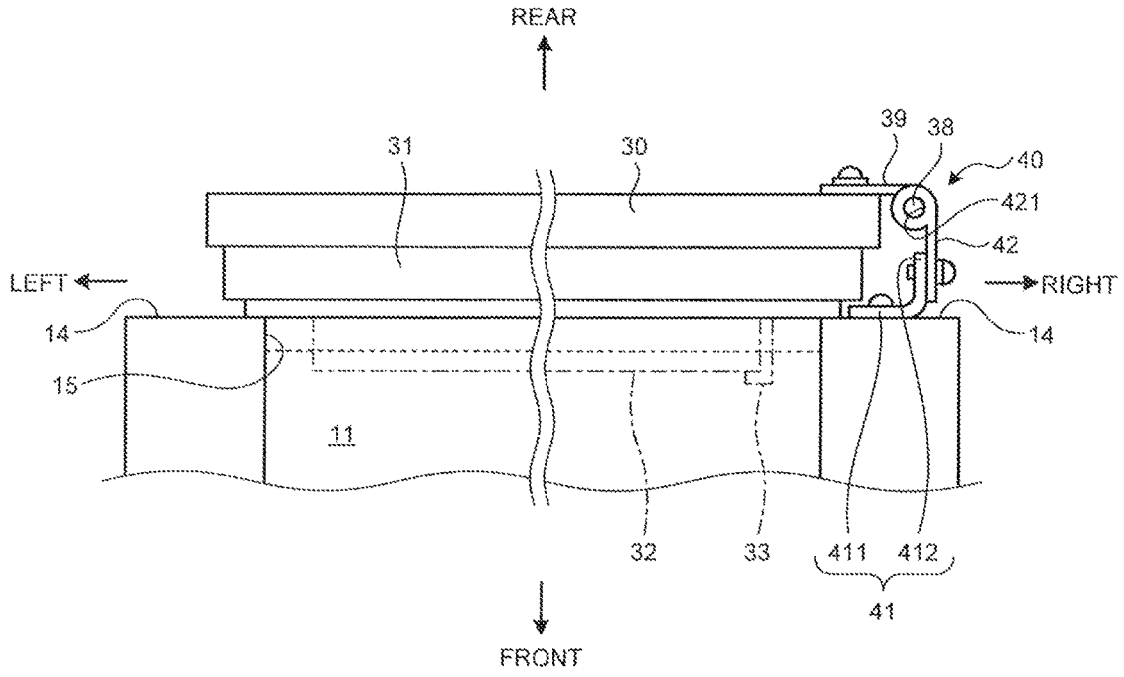
FIG. 18 is an enlarged plan view schematically illustrating the rear face side of a case main body in the showcase illustrated in FIG. 1 in an enlarged manner.

As illustrated in FIG. 18, the door 30 is supported by a door supporting member 40. Two door supporting members 40 are arranged in the up-and-down direction, for example. Each of the door supporting members 40 is arranged at the right edge (the metallic frame) of the rear face opening 15 constituting the rear face 14 of the case main body 10 and includes a mounting part 41 and shaft holding part 42.

The mounting part 41 is a plate-shaped member forming an L shape when viewed from above and includes a mounting base 411 mounted on the right edge with a screw or the like and a mounting rearward-extending part 412 extending rearward from the right end of the mounting base 411.

The shaft holding part 42 is constituted with its front end mounted on the mounting rearward-extending part 412 with a screw or the like and with its tongue-shaped rear end formed at certain intervals in the up-and-down direction formed in a curled shape so as to form a hollow hole causing a shaft 38 extending in the up-and-down direction to pass therethrough. In the shaft holding part 42, its basal end is mounted on the rear face 14 of the door 30, and its distal end constitutes a hinge with a door shaft holding unit 39 that winds the shaft 38. In other words, the shaft holding part 42 is rotatable with respect to the door shaft holding unit 39 mutually about the central axis of the shaft 38. With this structure, the door 30 moves to open and close in a swinging manner about the central axis of the shaft 38.

Consequently, the door supporting member 40 supports the door 30 in an openable and closable manner in a swinging manner about the central axis of the shaft 38 held through the shaft holding part 42. The door supporting member 40 holds the shaft 38 at the right side of the right edge of the rear face opening 15 while separating the shaft 38 rearward from the rear face 14 of the case main body 10.

Figure 19:
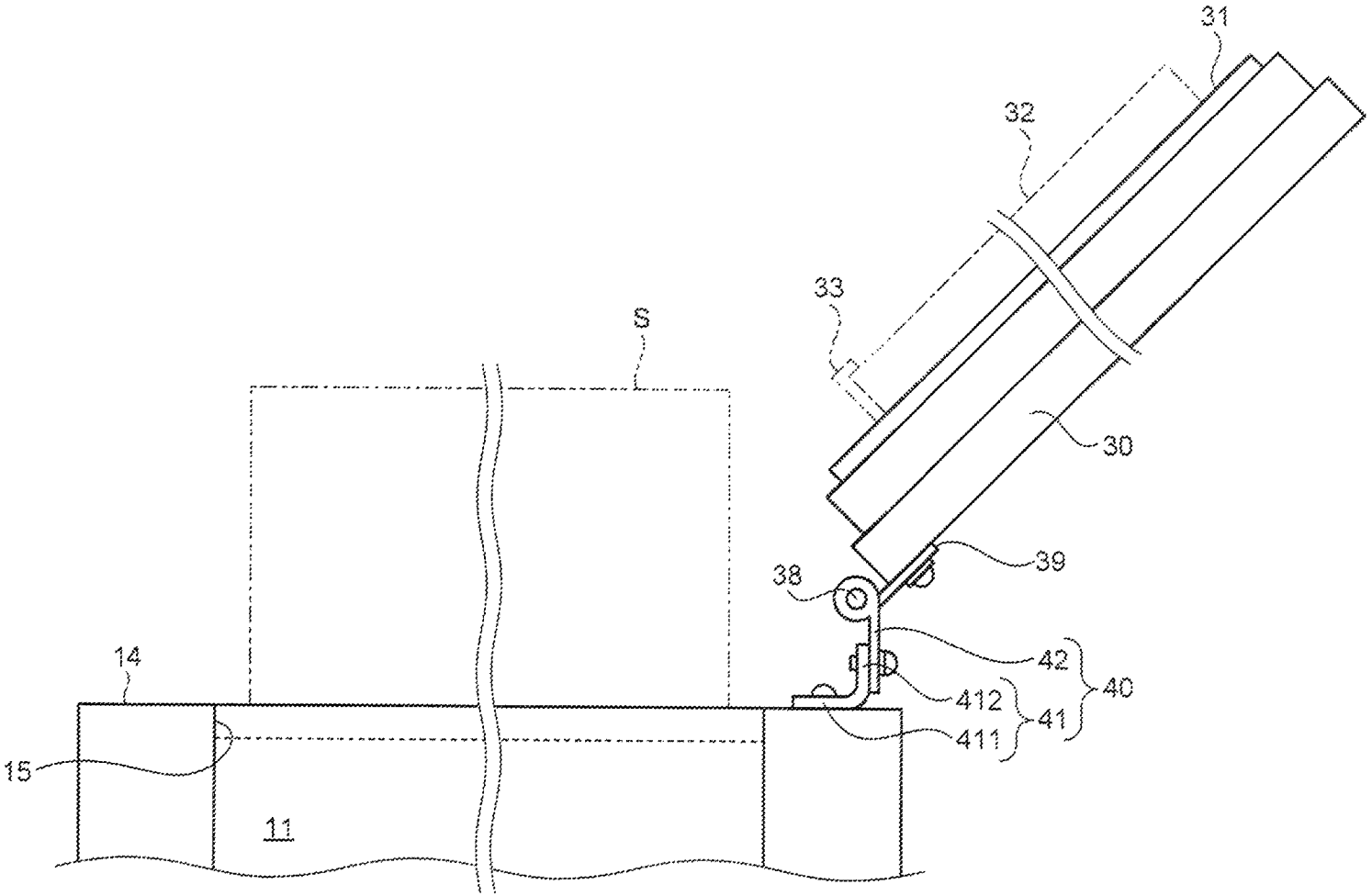
FIG. 19 is an enlarged plan view schematically illustrating the rear face side of the case main body in the showcase illustrated in FIG. 1 in an enlarged manner.

As illustrated in FIG. 19, when the door 30 is operated to open, the door supporting member 40 allows the door 30 to move to open so that not only the gasket 31 but also the rear face duct 32 and the right duct cover 33 mounted on the front face of the door 30 retract from an area S in which the shelf board 19 can slidingly move rearward as illustrated by a chain double-dashed line in FIG. 19. Reference sign 30*a* in FIG. 1 indicates a handle arranged on the rear face 14 of the door 30.

In the showcase having the above configuration, the circulating fan 53 is driven with the door 30 blocking the rear face opening 15, and the air inside the storage room 11 thereby passes through the inlet flow channels 235 through the first air inlets 231 and then reaches the cooler 51 through the second air inlet 232. The air that has reached the cooler 51 passes the air passage to be cooled, passes through the wind tunnel 56, and is blown out into the storage room 11 through the second air outlet 234 and the first air outlet 233.

The air blown out through the first air outlet 233 is introduced to the rear face duct 32 through the inlet 321, passes through the air passage 32*a*, is injected frontward through the injection holes 322, passes near the articles on the article mounting shelves 16, and is evacuated into the first air inlets 231, thus repeating the above-described circulation. Consequently, the air inside the storage room 11 is cooled, thereby cooling the articles carried on the article mounting shelves 16.

Meanwhile, the radiator fan 54 is driven, and outside air passes through the air passage of the radiator 52 through the drawing port 63 to be heated and is then discharged to the outside from the discharge port 64. The air discharged to the outside is moved rearward by the guide member 75, passes near the drain pan 71, and is discharged.

In the showcase, when work to take out the articles mounted on the article mounting shelves 16 is performed, the door 30 is operated to open and moved to open, thereby opening the rear face opening 15. Subsequently, a pull-out operation for pulling out the shelf board 19 of the article mounting shelf 16 that mounts a desired article rearward is performed, thereby causing the shelf board 19 to slidingly move rearward, and the work to take out the article is performed.

After the article is taken out, a pushing operation that pushes in the shelf board 19 frontward is performed after the pull-out operation, thereby causing the shelf board 19 to slidingly move frontward. Subsequently, the door 30 is operated to close and moved to close, thereby causing the gasket 31 to adhere to the periphery of the rear face opening 15 on the rear face 14 of the case main body 10 and blocking the rear face opening 15.

In the showcase as the present embodiment as described above, the door 30 is operated to open and moved to open, thereby opening the rear face opening 15 the shelf board 19 of the desired article mounting shelf 16 is operated to be pulled out, and the shelf board 19 is slidingly moved out of the case main body 10 through the rear face opening 15, thereby enabling work to take out the article or the like to be performed on the shelf board 19 slidingly moved out of the case main body 10 without an employee of a store inserting his or her fingers inside the case main body, unlike conventional cases. Consequently, work to take out articles or the like can be easily performed.

In particular, the handle 194 is formed so as to extend upward at the central part in the right-and-left direction at the rear end of the shelf board 19, and an employee of a store or the like can favorably pull out the shelf board 19 while gripping the handle 194.

In addition, the shelf board 19 constituting the article mounting shelf 16 can easily be removed from the receiving members 18 by disengaging the hooks 193 from the front edge of the receiving oblong holes 184 of the receiving members 18, and cleaning of the shelf board 19 or the like can easily be performed.

Furthermore, moving the brackets 17 inward with respect to the shelf columns 20 enables disengaging the locking pins 175 from the second locking holes 202 while disengaging the locking pieces 172 from the first locking holes 201, thereby enabling the brackets 17 to be easily removed together with the rails 21 and the receiving members 18, and cleaning of the brackets 17 or the like can easily be performed.

In the showcase, the heat insulating bottom plate 23 forms the first air inlets 231 formed in the face facing the storage room 11 and the second air inlet 232 formed in the face facing the machine room 12 at the positions that do not overlap with each other in the up-and-down direction, in which the first air inlets 231 and the second air inlet 232 communicate with each other via the inlet flow channels 235. Thus, even when an air inlet cannot be formed at a position in which an air inlet is originally desired to be formed, a reduction in the volume of the storage room 11 can be prevented with the height dimension, the width dimension, and the like of the entire showcase maintained. Consequently, a reduction in number of articles to be stored can be prevented without increasing the height dimension and the like.

In the showcase, the air cooled by the cooler 51 is introduced into the air passage 32*a* of the rear face duct 32 by the drive of the circulating fan 53, thereby being moved upward along the front face of the door 30 while being injected frontward out of the injection holes 322. Consequently, the air is caused to pass near the articles carried on the article mounting shelves 16, thereby enabling the air inside the entire storage room 11 to be cooled at an early stage. With this operation, a time required to cool the articles carried on the article mounting shelves 16 can be reduced.

In the showcase, the rear face duct 32 is arranged on the door 30 in a detachable manner, and the rear face duct 32 is detached from the door 30, thereby enabling cleaning of the rear face duct 32 or the like to be easily performed.

Furthermore, in the showcase, the rear face duct 32 is formed of a transparent resin material or the like together with the door 30, thereby enabling the storage room 11 to be visually recognized even from the rear side.

In the showcase, when the door 30 is operated to open, the door supporting member 40 allows the doors 30 to move to open so that not only the gasket 31 but also the members mounted on the front face of the door 30 retract from the area S in which the shelf board 19 can slidingly move rearward, and the gasket 31 and the shelf board 19 do not interfere with each other, and the gasket 31 can be prevented from breaking or the like. The gasket 31 can be thus prevented from breaking or the like, resulting in ability to maintain the hermeticity of the storage room 11 for a long term when the door 30 blocks the rear face opening 15 and ability to extend the service life.

The door supporting member 40 holds the shaft 38 at the position separated rearward from the rear face 14 of the case main body 10, and when the door 30 blocks the rear face opening 15, the front face of the gasket 31 can be brought into contact with the periphery of the rear face opening 15 in the rear face 14 of the case main body 10. In other words, when the door 30 blocks the rear face opening 15, only the gasket 31 arranged at the right side of the front face of the door 30, which is closest to the shaft 38, is prevented from becoming elastically deformed earlier than the other gasket 31, and the gasket 31 is prevented from breaking or the like earlier than the other gasket 31. Consequently, this prevention can also extend the service life.

Furthermore, the gasket 31 is the magnet gasket, and when the door 30 that moves to close approaches the case main body 10 to a certain extent, the gasket 31 adheres to the periphery of the rear face opening 15 of the case main body 10 through magnetic force, thus enabling the hermeticity of the storage room 11 to be increased and the door 30 to surely block the rear face opening 15.

In the showcase, the cooler 51 and the circulating fan 53 cool the air inside the storage room 11, and the articles carried on the article mounting shelves 16 can be favorably cooled. The guide member 75 causes the outside air heated by the radiator 52 to pass toward the drain pan 71, and the drain water generated inside the case main body 10 can favorably be evaporated and disposed of.

In particular, the outside air heated by the radiator 52 is caused to pass toward the drain pan 71, thereby downsizing the drain pan 71. By thus downsizing the drain pan 71, the wind tunnel 56 through which the air cooled by the cooler 51 passes can relatively be upsized. Consequently, article cooling efficiency by the cooler 51 can be improved.

The guide member 75 causes the heated outside air to pass toward the drain pan 71, and an evaporation sheet or the like for evaporating the drain water stored in the drain pan 71 is eliminated, thereby enabling an increase in manufacturing costs to be reduced.

Furthermore, the guide member 75 causes the heated outside air to pass toward the drain pan 71, and the outside air passes rearward. In the showcase with the front face 13 as the customer serving face, the outside air supplied to evaporate the drain water is not blown out toward a person intending to purchase an article.

Although the preferred embodiment of the present invention has been described, the present invention is not limited thereto, and various alterations can be made.

Although in the embodiment the door supporting members 40 is arranged at the right edge of the rear face opening 15 in the rear face 14 of the case main body 10, the arrangement position is not limiting so long as it is at one edge of the opening in the rear face.

The heat insulating bottom plate that defines the storage room and the machine room forms the first air inlets formed in the face facing the storage room and the second air inlet formed at the position that does not overlap with the first air inlets in the up-and-down direction in the face facing the machine room so that the first air inlets and the second air inlet communicate with each other via the inlet flow channels, and even when an air inlet cannot be formed at a position in which an air inlet is originally desired to be formed, a reduction in the volume of the storage room can be prevented with the height dimension, the width dimension, and the like of the entire showcase maintained. Consequently, an effect of making it possible to prevent a reduction in number of articles to be stored without increasing the height dimension and the like is produced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A showcase comprising:

a box-shaped case main body having an interior thereof sectioned into a storage room and a machine room;

article mounting shelves arranged in a plurality of stages in an up-and-down direction in the storage room and carrying thereon articles to be stored;

a circulating unit configured to circulate air from an inside of the storage room between the storage room and the machine room;

a cooler arranged in the machine room and configured to cool the air circulated through the circulating unit; and a bottom plate disposed between the storage room and the machine room, and configured to allow circulation of the air through the circulating unit, the bottom plate comprising:

a board, which is a plate-shaped member;

a deck pan, which is a plate-shaped member arranged so as to cover an entire upper surface of the board and has an upper surface facing the storage room;

a first air inlet formed in the deck pan facing the storage room;

a second air inlet formed at a position that is in the board facing the machine room and does not overlap with the first air inlet in the up-and-down direction; and an inlet flow channel formed so as to cause the first air inlet and the second air inlet to communicate with each other, wherein the deck pan includes a first air outlet, and the board includes a second air outlet formed at position overlapped with the first air outlet in the up-and-down direction to communicate with each other such that the air through the cooling unit is fed into the storage room from the machine room through the first air outlet and the second air outlet; and the cooler is arranged under the second air inlet to cool the air from the storage room, and the circulating unit is a circulating fan arranged between the second air inlet and the second air outlet in the machine room to flow the air through the cooler toward the first air outlet and the second air outlet.

2. The showcase according to claim 1, wherein the second air inlet is formed at a position horizontally spaced apart from the first air inlet, and the inlet flow channel is defined by and sandwiched between the board and the deck pan.

3. The showcase according to claim 1, further comprising a radiator arranged in the machine room and configured to radiate high-temperature waste heat generated by cooling the air with the cooler to surroundings, wherein the cooler is thermally connected to a low-temperature part of a Peltier element, whereas the radiator is thermally connected to a high-temperature part of the Peltier element.

4. The showcase according to claim 1, wherein the first air inlet includes a first inlet portion formed at one side of the deck pan, and a second inlet portion formed at another side of the deck pan opposite to the one side, and the first air outlet is formed at a rear side of the case main body between the first inlet portion and the second inlet portion; and the second air inlet is formed at a center portion of the board above the cooler, and the second air outlet is formed at the rear side of the case main body to overlap with the first air outlet.

5. The showcase according to claim 1, further comprising:

a cooling unit arranged in the machine room to separate the machine room between the board and a bottom of the case main body, and having the cooler at one side of the machine room and a radiator at another side of the machine room;

a radiation fan disposed in the another side of the machine room, the radiation fan drawing outside air through a drawing port in the bottom of the case main body, passing the radiator and discharging the outside air to an outside of the case main body through a discharge port arranged in the bottom of the case main body; and a guide member arranged in the bottom of the case main body, and configured to prevent the air discharged out of the discharge port from passing toward the drawing port, and guide the air to pass near a drain pan, wherein the circulating unit includes a circulating fan disposed in the one side of the machine room, the circulating fan drawing the air in the storage room through the first air inlet and the second air inlet to pass through the cooler, and discharging the air passing through the cooler to return to the storage room through air outlets formed in the deck pan and the board.

6. The showcase according to claim 1, further comprising:

a door configured to open and close an opening formed in a rear face of the case main body;

a duct arranged on a front face of the door, and configured to introduce the air fed from the machine room to the storage room through the circulating unit, cause the air to pass along the front face of the door, and inject the air frontward from injection holes formed in the duct.

7. The showcase according to claim 6, wherein the duct is arranged on the front face of the door in a detachable manner.

8. The showcase according to claim 6, wherein the duct is formed of a transparent material together with the door and makes the storage room visually recognizable through the door and the duct.

9. The showcase according to claim 1, further comprising:

a radiator arranged in the machine room and configured to radiate high-temperature waste heat generated by cooling the air with the cooler to surroundings;

a drain pan configured to store therein drain water generated within the case main body;

an air blowing unit configured to be driven to cause outside air to pass near the radiator and thereafter discharge the outside air to an outside of the case main body through a discharge port arranged in the case main body, the outside air having been drawn through a drawing port arranged in the case main body; and a guide member arranged in the case main body, and configured to prevent the air discharged out of the discharge port from passing toward the drawing port, and guide the air to pass near the drain pan.

10. The showcase according to claim 9, wherein the drawing port and the discharge port are formed in a bottom face of the case main body, and the guide member guides the air blown out of the discharge port to pass rearward.

11. The showcase according to claim 9, wherein the cooler is thermally connected to a low-temperature part of a Peltier element, whereas the radiator is thermally connected to a high-temperature part of the Peltier element.

* * * * *